US006744201B2

(12) United States Patent
Nakayama et al.

(10) Patent No.: US 6,744,201 B2
(45) Date of Patent: Jun. 1, 2004

(54) PLASMA INFORMATION DISPLAY ELEMENT AND METHOD FOR PRODUCING THE SAME

(75) Inventors: Junichiro Nakayama, Kyoto (JP); Masanobu Tanaka, Tokyo (JP)

(73) Assignee: Sharp Kabushiki Kaisha, Osaka (JP)

( * ) Notice: Subject to any disclaimer, the term of this patent is extended or adjusted under 35 U.S.C. 154(b) by 47 days.

(21) Appl. No.: 10/255,076

(22) Filed: Sep. 26, 2002

(65) Prior Publication Data

US 2003/0057831 A1 Mar. 27, 2003

(30) Foreign Application Priority Data

Sep. 26, 2001 (JP) ..... 2001-294616

(51) Int. Cl.[7] ..... H01J 17/49
(52) U.S. Cl. ..... 313/582; 313/587
(58) Field of Search ..... 313/582, 587

(56) References Cited

FOREIGN PATENT DOCUMENTS

| | | |
|---|---|---|
| JP | 5-234519 A | 9/1993 |
| JP | 9-185945 A | 7/1997 |
| JP | 10-106441 A | 4/1998 |
| JP | 11-3665 A | 1/1999 |

*Primary Examiner*—Vip Patel
(74) *Attorney, Agent, or Firm*—Nixon & Vanderhye, P.C.

(57) ABSTRACT

A plasma information display element of the present invention includes a first substrate; a second substrate opposing the first substrate; a plurality of barrier ribs provided between the first substrate and the second substrate; and a plurality of discharge channels defined by the first substrate, the second substrate and the barrier ribs. The plasma information display element further includes: an anode and a cathode provided on one side of the first substrate that is closer to the second substrate; and a protective layer provided so as to cover the anode and the cathode, wherein the protective layer is a layer that contains (220)-oriented MgO and (200)-oriented MgO.

7 Claims, 6 Drawing Sheets

PLASMA INFORMATION DISPLAY ELEMENT AND METHOD FOR PRODUCING THE SAME

BACKGROUND OF THE INVENTION

1. Field of the Invention

The present invention relates to a plasma information display element such as a plasma display panel (PDP) and a plasma addressed liquid crystal display device (PALC), and a method for producing the same.

2. Description of the Background Art

In recent years, a plasma information display element such as a plasma display panel (PDP) and a plasma addressed liquid crystal display device (PALC) has been attracting public attention.

PDPs are generally classified into those of DC type and those of AC type. At present, AC-type PDPs are the mainstream in view of the discharge stability and the long-term reliability, and AC-type PDPs have already been commercially available.

A structure of a conventional AC-type PDP 300 will be described with reference to FIG. 8. FIG. 8 is a cross-sectional view schematically illustrating the PDP 300. Note that FIG. 8 shows a front substrate 310 in a schematic cross-sectional view taken in a direction that is parallel to the direction in which discharge channels 350 extend, and shows a rear substrate 320 in a schematic cross-sectional view taken in a direction that is perpendicular to the direction in which the discharge channels 350 extend.

The PDP 300 includes the front substrate 310 and the rear substrate 320 provided so as to oppose each other, and a plurality of barrier ribs 340 provided between the front substrate 310 and the rear substrate 320.

The barrier ribs 340 are arranged in a stripe pattern, and the discharge channels 350, which are also arranged in a stripe pattern, are defined each as a space surrounded by the front substrate 310, the rear substrate 320 and the barrier rib 340. This space, i.e., the discharge channel 350, is filled with a discharge gas that can be ionized by a discharge.

The front substrate 310 includes a transparent substrate 312, display electrodes 314 provided on the transparent substrate 312, a dielectric layer 316 provided so as to cover the display electrodes 314, and a protective layer 318 provided on the dielectric layer 316.

The display electrodes 314 of the front substrate 310 are arranged in a stripe pattern and in pairs. One of each pair of display electrodes 314 functions as an anode 314A and the other as a cathode 314C. Moreover, each display electrode 314 includes a transparent electrode 314*a* and a bus electrode 314*b* provided on the transparent electrode 314*a*.

The rear substrate 320 includes an insulative substrate 322, address electrodes 324 provided on the insulative substrate 322, and a dielectric layer 326 provided so as to cover the address electrodes 324. The address electrodes 324 are arranged in a stripe pattern so as to cross the display electrodes 314, with the barrier rib 340 described above being formed between each pair of adjacent address electrodes 324.

Phosphor layers 328 are formed each in a "U" shape on the side surface of the barrier ribs 340 and the upper surface of the dielectric layer 326. Typically, the phosphor layer 328 is a red phosphor layer 328R (e.g., a $(Y,Ga)BO_3$:Eu layer), a green phosphor layer 328G (e.g., a $Zn_2SiO_4$:Mn layer) or a blue phosphor layer 328B (e.g., a $BaMgAl_{14}O_{23}$:Eu layer).

The operation of the PDP 300 having such a structure will be described with reference to FIG. 9. FIG. 9 schematically illustrates the operation of the PDP 300. Note that the PDP 300 has a plurality of picture element regions arranged in a matrix pattern, and a pair of one display electrode 314 and one address electrode 324 intersect each other in each of the picture element regions. Moreover, in a write operation to be described later, one of each pair of display electrodes 314 functions as a scanning electrode.

First, a write discharge is caused selectively in a predetermined picture element region by applying a voltage that exceeds a discharge threshold between one scanning electrode (one of a pair of display electrodes 314) and one address electrode 324. Through the write discharge, a charge is induced/stored around the surface of the dielectric layer 316 above the scanning electrode. Note that such induction/storage of a charge is also referred to as the formation of a wall charge.

Next, a voltage that does not exceed the discharge threshold is applied between a pair of display electrodes 314. At this time, in the predetermined picture element region in which the write discharge has been caused, this voltage is superimposed on a wall voltage that occurs due to the wall charge formed in the write operation, whereby the effective voltage in the region exceeds the discharge threshold, thus initiating a sustain discharge. A predetermined picture element region can be brought into an illuminated state by illuminating the phosphor layer 328 using ultraviolet rays that are generated by the sustain discharge.

In the PDP 300, which operates as described above, the protective layer 318 is provided for the purpose of protecting the display electrodes 314 and the dielectric layer 316 from a discharge (plasma discharge). Typically, an MgO layer is used as the protective layer 318.

Japanese Laid-Open Patent Publication No. 5-234519 discloses a PDP in which the discharge voltage is reduced by using a (111)-oriented MgO layer as the protective layer. Moreover, Japanese Laid-Open Patent Publication No. 10-106441 discloses a PDP in which the anti-sputtering property (the resistance against sputtering due to a plasma discharge) of the protective layer is improved by using a (220)-oriented MgO layer (disclosed as a (110)-oriented MgO layer in the publication) as the protective layer.

However, a (111)-oriented MgO layer, which is provided as the protective layer in the PDP disclosed in Japanese Laid-Open Patent Publication No. 5-234519, does not have a sufficient anti-sputtering property though it has a desirable property for reducing the discharge voltage.

Moreover, a (220)-oriented MgO layer, which is provided as the protective layer in the PDP disclosed in Japanese Laid-Open Patent Publication No. 10-106441 does not have a sufficient property for reducing the discharge voltage though it has a sufficient anti-sputtering property.

SUMMARY OF THE INVENTION

The present invention has been made in view of these problems in the art, and has an object to provide a plasma information display element that includes a protective layer with a desirable anti-sputtering property and has a reduced discharge voltage, and a method for producing the same.

A plasma information display element of the present invention includes: a first substrate; a second substrate opposing the first substrate; a plurality of barrier ribs provided between the first substrate and the second substrate; a plurality of discharge channels defined by the first substrate, the second substrate and the barrier ribs; an anode and a cathode provided on one side of the first substrate that is closer to the second substrate; and a protective layer provided so as to cover the anode and the cathode, wherein the protective layer is a layer that contains (220)-oriented MgO and (200)-oriented MgO. Thus, the object set forth above is achieved. Note that "(220)-oriented MgO" refers to an MgO crystal in which the crystal plane parallel to the layer plane is the (220) plane, and "(200)-oriented MgO" refers to an MgO crystal in which the crystal plane parallel to the layer plane is the (200) plane.

The protective layer may be provided directly on the anode and the cathode.

The plasma information display element may further include a dielectric layer provided between the anode and the cathode and the protective layer.

It is preferred that the protective layer is a layer that is substantially made only of (220)-oriented MgO and (200)-oriented MgO.

The plasma information display element may further include: a third substrate provided so as to oppose the second substrate; and a liquid crystal layer provided between the second substrate and the third substrate.

Each of the discharge channels may further include a phosphor layer.

A method of the present invention is a method for producing a plasma information display element, the plasma information display element including: a first substrate; a second substrate opposing the first substrate; a plurality of barrier ribs provided between the first substrate and the second substrate; a plurality of discharge channels defined by the first substrate, the second substrate and the barrier ribs; an anode and a cathode provided on one side of the first substrate that is closer to the second substrate; and a protective layer provided so as to cover the anode and the cathode, the method including the steps of: preparing the first substrate, in which the anode and the cathode have been formed; and forming the protection layer that contains (220)-oriented MgO and (200)-oriented MgO by depositing an MgO-containing layer so as to cover the anode and the cathode with the first substrate being heated to a temperature of 200° C. or more. Thus, the object set forth above is achieved.

Functions of the present invention will now be described.

In the plasma information display element of the present invention, the protective layer, which is provided so as to cover the anode and the cathode, is a layer that contains (220)-oriented MgO and (200)-oriented MgO. Therefore, it is possible to reduce the discharge voltage while suppressing the sputtering of the protective layer by a plasma discharge.

The plasma information display element may further include the dielectric layer provided between the anode and the cathode and the protective layer, or the protective layer may be provided directly on the anode and the cathode. If a structure where the dielectric layer described above is provided is employed, the sputtering of the protective layer is better suppressed, thus improving the reliability of the plasma information display element. If a structure where the protective layer is provided directly on the anode and the cathode is employed, the step of forming a layer (e.g., the dielectric layer described above) between the anode and the cathode and the protective layer can be omitted, thereby reducing the production cost.

In order to reduce the discharge voltage while realizing a desirable anti-sputtering property, it is preferred that the protective layer is a layer that is substantially made only of (220)-oriented MgO and (200)-oriented MgO.

The method for producing a plasma information display element of the present invention includes the step of forming the protection layer that contains (220)-oriented MgO and (200)-oriented MgO by depositing an MgO-containing layer so as to cover the anode and the cathode with the first substrate being heated to a temperature of 200° C. or more. Therefore, it is possible to efficiently produce a plasma information display element that includes a protective layer with a desirable anti-sputtering property and has a reduced discharge voltage.

Thus, the present invention provides a plasma information display element that includes a protective layer with a desirable anti-sputtering property and has a reduced discharge voltage, and a method for producing the same.

In the plasma information display element of the present invention, the protective layer, which is provided so as to cover the anode and the cathode, is a layer that contains (220)-oriented MgO and (200)-oriented MgO. Therefore, it is possible to reduce the discharge voltage while suppressing the sputtering of the protective layer by a plasma discharge.

The present invention can suitably be used with a plasma information display element such as a plasma display panel (PDP) and a plasma addressed liquid crystal display device (PALC).

DETAILED DESCRIPTION OF THE PREFERRED EMBODIMENTS

The present inventors have made various researches aiming at the objective of reducing the discharge voltage while suppressing the sputtering of the protective layer, and have arrived at the present invention by finding that the discharge voltage can be reduced while suppressing the sputtering of the protective layer by using a layer that contains (220)-oriented MgO and (200)-oriented MgO as the protective layer.

Plasma information display elements, and methods for producing the same, according to embodiments of the present invention will now be described with reference to the drawings. Note that the present invention is not limited to these embodiments.

Embodiment 1

Figure 1:
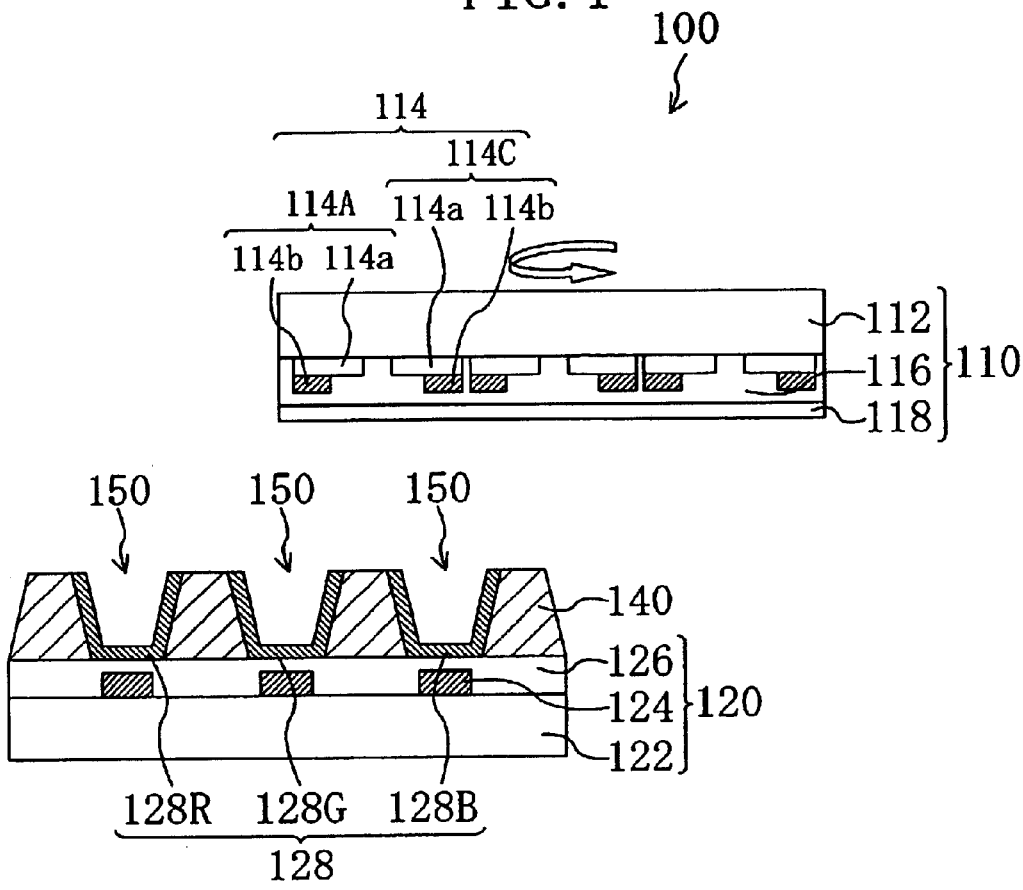
FIG. 1 is a cross-sectional view schematically illustrating a plasma display panel (PDP) 100, which is a plasma information display element of Embodiment 1 of the present invention.

The structure of a plasma display panel (PDP) 100, which is a plasma information display element of Embodiment 1 of the present invention, will be described with reference to FIG. 1. FIG. 1 is a cross-sectional view schematically illustrating the PDP 100. Note that FIG. 1 shows a first substrate 110 in a schematic cross-sectional view taken in a direction that is parallel to the direction in which discharge channels 150 extend, and shows a second substrate 120 in a schematic cross-sectional view taken in a direction that is perpendicular to the direction in which the discharge channels 150 extend.

The PDP 100 includes the first substrate (front substrate) 110 and the second substrate (rear substrate) 120 provided so as to oppose each other, and a plurality of barrier ribs 140 provided between the first substrate 110 and the second substrate 120.

The barrier ribs 140 are typically arranged in a stripe pattern, and the discharge channels 150, which are also arranged in a stripe pattern, are defined each as a space surrounded by the first substrate 110, the second substrate 120 and the barrier rib 140. In other words, the PDP 100 includes a plurality of discharge channels 150 between the first substrate 110 and the second substrate 120. The first substrate 110 and the second substrate 120 are attached to each other with a gap on the order of 100 $\mu$m therebetween, and the discharge channel 150 is filled with a discharge gas (e.g., a mixed gas of Ne and Xe) that can be ionized by a discharge.

The first substrate 110 includes a transparent substrate (e.g., a glass substrate) 112, display electrodes 114 provided on the transparent substrate 112, a first dielectric layer (e.g., a low-melting-point glass layer) 116 provided so as to cover the display electrodes 114, and a protective layer 118 provided on the first dielectric layer 116.

The display electrodes 114 of the first substrate 110 are typically arranged in a stripe pattern and in pairs. One of each pair of display electrodes 114 functions as an anode 114A and the other as a cathode 114C. In the present embodiment, each display electrode 114 includes a transparent electrode (e.g., an ITO layer) 114*a* and a bus electrode (e.g., an Al layer, an Ag—Pd—Cu layer, an Ag—Ru—Cu layer or an Ag—$SnO_2$ layer) 114*b* provided on the transparent electrode 114*a*.

The protective layer 118 is provided so as to cover the display electrodes 114 (i.e., the anodes 114A and cathodes 114C) and the first dielectric layer 116, and is a layer that contains (220)-oriented MgO and (200)-oriented MgO. In the present embodiment, the protective layer 118 is a layer that is substantially made only of (220)-oriented MgO and (200)-oriented MgO.

The second substrate 120 includes an insulative substrate (e.g., a glass substrate) 122, address electrodes (e.g., an Al layer, an Ag—Pd—Cu layer, an Ag—Ru—Cu layer or an Ag—$SnO_2$ layer) 124 provided on the insulative substrate 122 and in a stripe pattern so as to cross the display electrodes 114, and a second dielectric layer (e.g., a low-melting-point glass layer) 126 provided so as to cover the address electrodes 124. The barrier rib 140 described above is formed between each pair of adjacent address electrodes 124 by using a low-melting-point glass, for example.

Phosphor layers 128 are formed each in a "U" shape on the side surface of the barrier ribs 140 and the upper surface of the second dielectric layer 126. Typically, the phosphor layer 128 is a red phosphor layer 128R (e.g., a (Y,Ga)$BO_3$:Eu layer), a green phosphor layer 128G (e.g., a $Zn_2SiO_4$:Mn layer) or a blue phosphor layer 128B (e.g., a $BaMgAl_{14}O_{23}$:Eu layer).

Next, the operation of the PDP 100 of the present embodiment will be described. Note that the PDP 100 has a plurality of picture element regions arranged in a matrix pattern, and a pair of one display electrode 114 and one address electrode 124 intersect each other in each of the picture element regions. Moreover, in a write operation to be described later, one of each pair of display electrodes 114 functions as a scanning electrode.

First, a write discharge is caused selectively in a predetermined picture element region by applying a voltage that exceeds a discharge threshold between one scanning electrode (one of a pair of display electrodes 114) and one address electrode 124. Through the write discharge, a charge is induced/stored around the surface of the first dielectric layer 116 above the scanning electrode. Note that such induction/storage of a charge is also referred to as the formation of a wall charge.

Next, a voltage that does not exceed the discharge threshold is applied between a pair of display electrodes 114. At this time, in the predetermined picture element region in which the write discharge has been caused, this voltage is superimposed on a wall voltage that occurs due to the wall charge formed in the write operation, whereby the effective voltage in the region exceeds the discharge threshold, thus initiating a sustain discharge. A predetermined light-emitting cell can be brought into an illuminated state by illuminating the phosphor layer 128 using ultraviolet rays that are generated by the sustain discharge.

Next, a method for producing the PDP 100 of the present embodiment will be described.

First, the first substrate 110, in which the display electrodes 114 (i.e., the anodes 114A and the cathodes 114C) have been formed on the transparent substrate 112, is prepared. This step can be carried out by using a known method with known materials.

Then, the first dielectric layer 116 is formed so as to cover the anodes 114A and the cathodes 114C. The step of forming the first dielectric layer 116 can be carried out by using a known method with known materials.

Then, an MgO layer is deposited so as to cover the anodes 114A and the cathodes 114C with the first substrate 110 being heated to a temperature of 200° C. or more, thereby forming the protective layer 118 that contains (220)-oriented MgO and (200)-oriented MgO.

Then, the second substrate 120, in which the address electrodes 124 and the second dielectric layer 126 have been formed on the insulative substrate 122, is prepared. The step of forming the address electrodes 124 and the second dielectric layer 126 can be carried out by using a known method with known materials.

Then, the barrier ribs 140 are formed so that each barrier rib 140 is positioned between a pair of adjacent address electrodes 124, and the phosphor layers 128 are formed each in a "U" shape on the side surface of the barrier ribs 140 and the upper surface of the second dielectric layer 126. The step of forming the barrier ribs 140 and the phosphor layers 128 can be carried out by using a known method with known materials.

Then, the first substrate 110 and the second substrate 120 are attached to each other with a predetermined gap therebetween. Then, the gap is filled with a discharge gas and is sealed, thereby obtaining the PDP 100.

The step of forming the protective layer 118 will now be described in greater detail.

Figure 2:
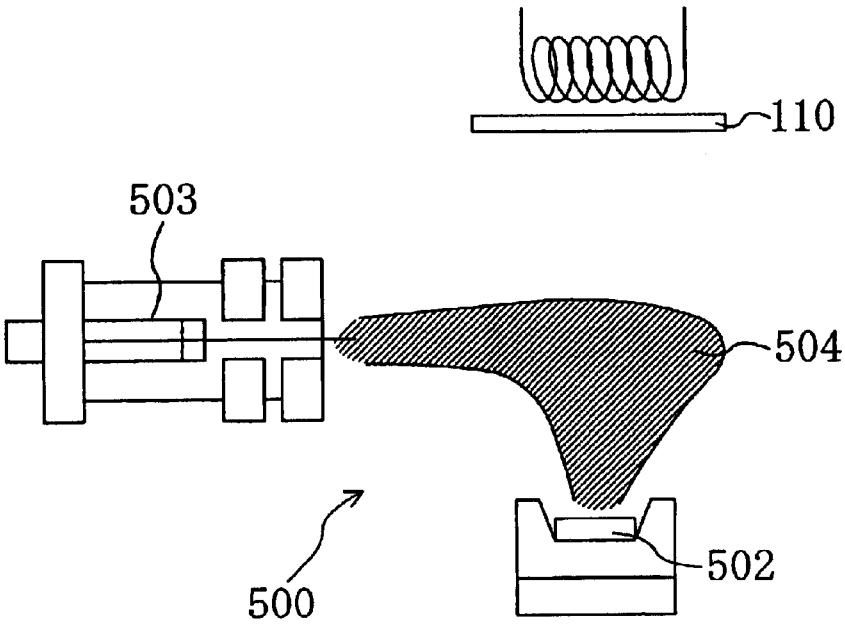
FIG. 2 is a diagram schematically illustrating an ion plating deposition apparatus 500 used in the step of forming a protective layer 118, which is provided in the PDP 100 of Embodiment 1 of the present invention.

The step of forming the protective layer 118 described above is carried out as follows using, for example, an ion plating deposition apparatus 500 manufactured by Chugai Ro Co., Ltd., which is schematically illustrated in FIG. 2.

First, the first substrate 110, in which the anodes 114A, the cathodes 114C and the first dielectric layer 116 have been formed, is placed in a vacuum chamber and is positioned to be parallel to a vapor deposition source 502.

Then, the first substrate 110 is heated to a temperature of 200° C. or more by resistance heating or laser irradiation, for example. With the first substrate 110 being heated to a temperature of 200° C. or more, the vapor deposition source 502 is irradiated with an ion beam 504 from a plasma gun 503 so that an MgO layer is deposited on the first substrate 110, thereby forming the protective layer 118 that contains (220)-oriented MgO and (200)-oriented MgO. The temperature of the first substrate 110 is preferably equal to or greater than 200° C. and less than or equal to 600° C. in view of the melting points of the materials used in substrates, electrodes and dielectric layers, and is more preferably equal to or greater than 200° C. and less than or equal to 400° C. in view of the process time. In the present embodiment, the protective layer 118 having a thickness of about 1 $\mu$m is formed through a deposition process performed for about 15 minutes under conditions where the temperature of the first substrate 110 is 200° C. and the input power is about 7 kW while introducing a mixed gas containing oxygen and hydrogen at a ratio of about 10:3 at a pressure of about 0.1 Pa.

Figure 3A:
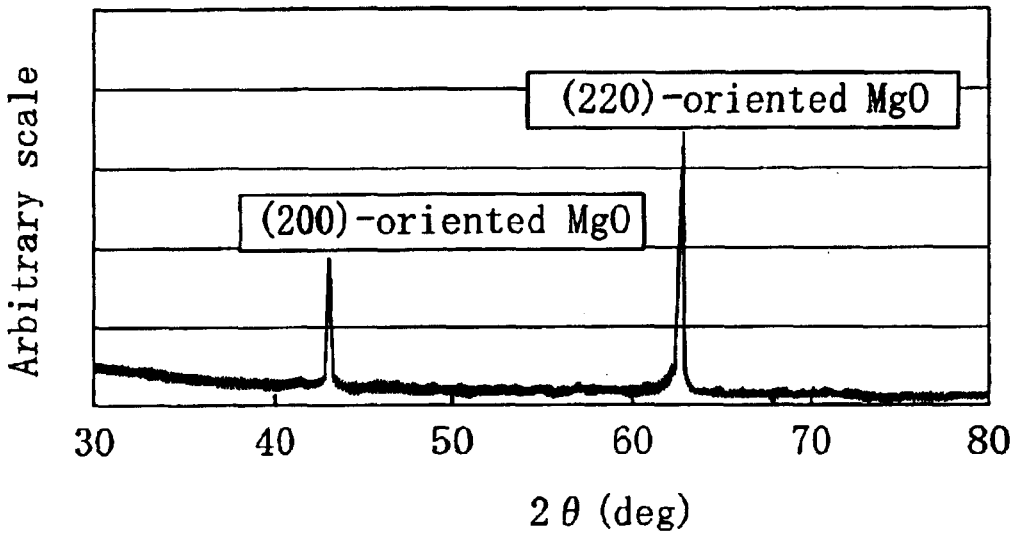
FIG. 3A is a graph illustrating the results of an X-ray diffraction measurement of the protective layer 118 provided in the PDP 100 of Embodiment 1 of the present invention.
Figure 3B:
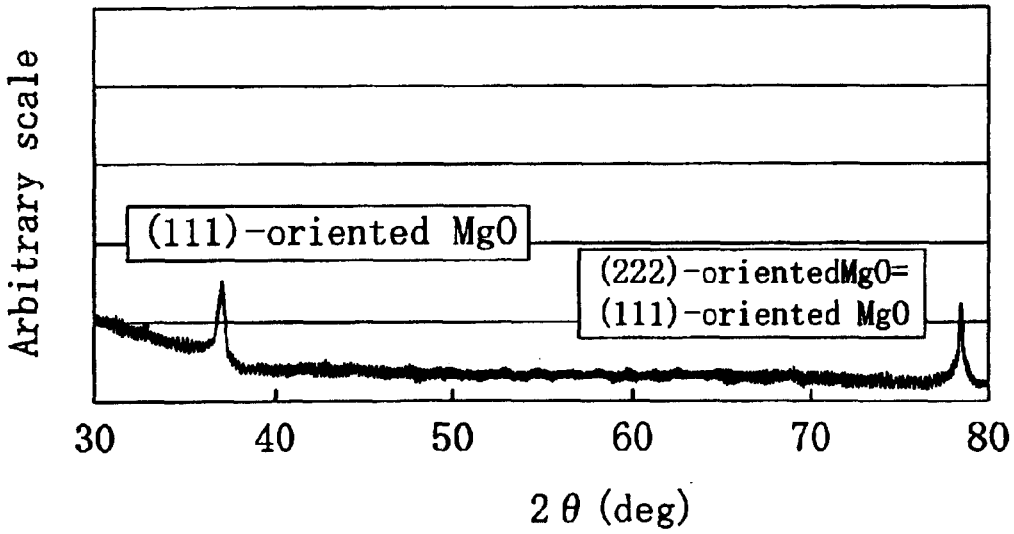
FIG. 3B is a graph illustrating the results of X-ray diffraction measurement of a (111)-oriented MgO layer.

FIG. 3A illustrates the results of an X-ray diffraction measurement of the protective layer 118 formed as described above. In FIG. 3A, the vertical axis represents the diffraction intensity, and the horizontal axis represents the Bragg reflection angle 2θ. As illustrated in FIG. 3A, a peak induced by (220)-oriented MgO and another peak induced by (200)-oriented MgO are observed, showing that the protective layer 118 of the PDP 100 of the present embodiment is a layer that is substantially made only of (220)-oriented MgO and (200)-oriented MgO. In contrast, FIG. 3B illustrates the results of an X-ray diffraction measurement of a (111)-oriented MgO layer, for example, in which a peak induced by (111)-oriented MgO and another peak induced by (222)-oriented MgO (=(111)-oriented MgO) are observed.

Table 1 below shows the MgO crystal orientation for different MgO layers that are obtained by varying the temperature of the first substrate 110 with the other deposition conditions being unchanged from those described above.

TABLE 1

| Substrate temperature | MgO orientation |
|---|---|
| Room temperature | (111) |
| 100° C. | (111) |
| 200° C. | (220) + (200) |
| 300° C. | (220) + (200) |

It can be seen from Table 1 that a layer that contains (220)-oriented MgO and (200)-oriented MgO can be formed by depositing an MgO layer with the temperature of the first substrate 110 being 200° C. or more. Moreover, when an MgO layer was formed and then left standing for about one hour in a nitrogen atmosphere at 485° C., the orientation did not change. This confirms that while the substrate temperature during the formation of an MgO layer influences the orientation, the substrate temperature after the formation of the MgO layer does not influence the orientation.

Table 2 below shows the MgO crystal orientation for MgO layers that are obtained by a sputtering method.

TABLE 2

| Substrate temperature | MgO orientation |
|---|---|
| No heating | (111) |
| 150° C. | (111) |
| 200° C. | (220) + (200) |

It can be seen from Table 2 that also in a case where a sputtering method is used, a layer that contains (220)-oriented MgO and (200)-oriented MgO can be formed by depositing an MgO layer with the temperature of the substrate being 200° C. or more.

It can be seen from the results shown in Table 1 and Table 2 that a layer that contains (220)-oriented MgO and (200)-oriented MgO can be formed by setting the temperature of the first substrate 110 to be 200° C. or more irrespective of the method by which the MgO layer is formed.

In the PDP 100 of Embodiment 1 of the present invention, the protective layer 118, which is provided so as to cover the anodes 114A and the cathodes 114C, is a layer that contains (220)-oriented MgO and (200)-oriented MgO. Therefore, it is possible to reduce the discharge voltage while suppressing the sputtering of the protective layer 118 by a plasma discharge.

The reason why a layer that contains (220)-oriented MgO and (200)-oriented MgO has a desirable anti-sputtering property will be described. Where the lattice constant of an MgO crystal is denoted as "a", the respective plane spacings of the (111) plane, the (200) plane and the (220) plane are as follows:

$$(111)\text{plane: } \{(\sqrt{3})/3\}\cdot a=0.58a$$

$$(200)\text{plane: } a/2=0.5a$$

$$(220)\text{plane: } \{(\sqrt{2})/4\}\cdot a=0.35a$$

Accordingly, it is believed that for a mixture of (220)-oriented MgO and (200)-oriented MgO, the plane spacing is about 0.4 a. Thus, a layer that contains (220)-oriented MgO and (200)-oriented MgO is more compact and has a higher density than a (111)-oriented MgO layer, while having substantially the same anti-sputtering property as that of a (220)-oriented MgO layer.

Moreover, as will be described later, the present inventors have experimentally confirmed that the discharge voltage of a plasma information display element can be reduced sufficiently by using a layer that contains (220)-oriented MgO and (200)-oriented MgO as the protective layer 118.

Embodiment 2

Figure 4:
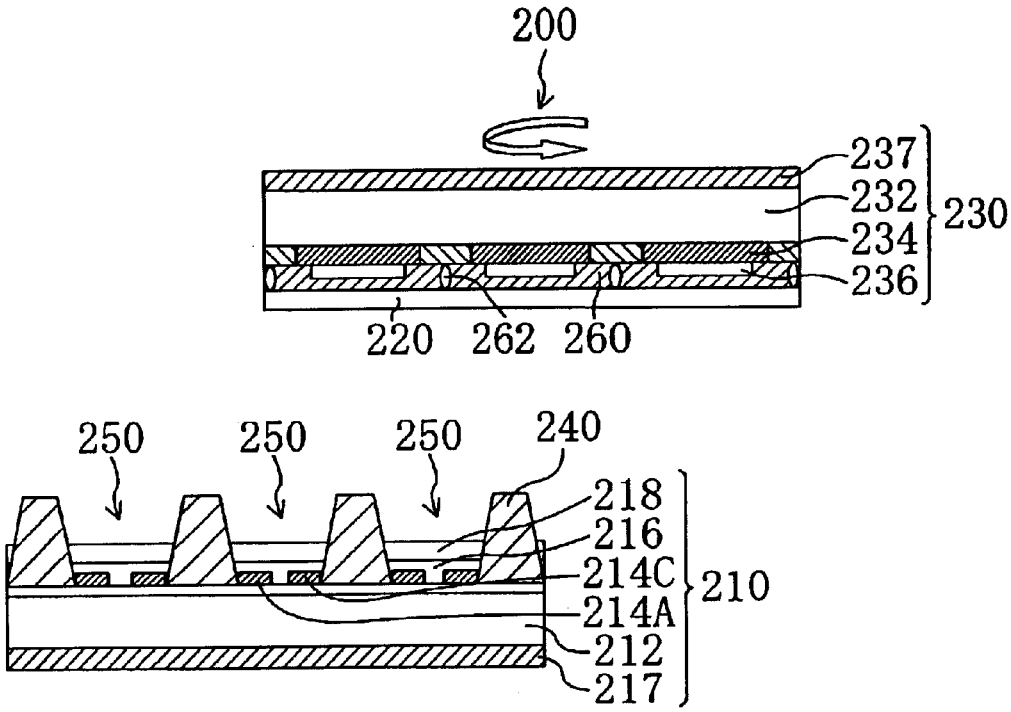
FIG. 4 is a cross-sectional view schematically illustrating a plasma addressed liquid crystal display device (PALC) 200, which is a plasma information display element of Embodiment 2 of the present invention.

The structure of a plasma addressed liquid crystal display device (PALC) 200, which is a plasma information display element of Embodiment 2 of the present invention, will be described with reference to FIG. 4. FIG. 4 is a cross-sectional view schematically illustrating the PALC 200. Note that FIG. 4 shows a first substrate 210 in a schematic cross-sectional view taken in a direction that is perpendicular to the direction in which discharge channels 250 extend, and shows a second substrate 220 and a third substrate 230 in a schematic cross-sectional view taken in a direction that is parallel to the direction in which the discharge channels 250 extend.

The PALC 200 includes the first substrate 210 and the second substrate 220 provided so as to oppose each other, and a plurality of barrier ribs 240 provided between the first substrate 210 and the second substrate 220.

The PALC 200 further includes the third substrate 230 provided so as to oppose the second substrate 220, and a liquid crystal layer 260 provided between the second substrate 220 and the third substrate 230.

The barrier ribs 240, which are provided between the first substrate 210 and the second substrate 220, are typically arranged in a stripe pattern, and the discharge channels 250, which are also arranged in a stripe pattern, are defined each as a space surrounded by the first substrate 210, the second substrate 220 and the barrier rib 240. In other words, the PALC 200 includes a plurality of discharge channels 250 between the first substrate 210 and the second substrate 220. The discharge channel 250 is filled with a discharge gas (e.g., Xe) that can be ionized by a discharge at a predetermined pressure (e.g., about 4000 Pa).

The first substrate 210 includes a transparent substrate (e.g., a glass substrate having a thickness of about 0.5 mm to about 3.0 mm) 212, a pair of an anode (e.g., an Al layer, an Ag—Pd—Cu layer, an Ag—Ru—Cu layer or an Ag—$SnO_2$ layer) 214A and a cathode (e.g., an Al layer, an Ag—Pd—Cu layer, an Ag—Ru—Cu layer or an Ag—$SnO_2$ layer) 214C arranged in a stripe pattern on the transparent substrate 212 for each of the discharge channels 250, a dielectric layer (e.g., a low-melting-point glass layer) 216 provided so as to cover the anodes 214A and the cathodes 214C, and a protective layer 218 provided on the dielectric layer 216.

The protective layer 218 is provided so as to cover the anodes 214A, the cathodes 214C and the dielectric layer 216, and is a layer that contains (220)-oriented MgO and (200)-oriented MgO. In the present embodiment, the protective layer 218 is a layer that is substantially made only of (220)-oriented MgO and (200)-oriented MgO.

The second substrate 220 is a thin transparent dielectric plate (e.g., a glass plate having a thickness of about 10 $\mu$m to about 100 $\mu$m), and the barrier ribs 240 provided between the second substrate 220 and the first substrate 210 are made of a low-melting-point glass, for example.

The third substrate 230 includes a transparent substrate (e.g., a glass substrate having a thickness of about 0.5 mm to about 2.0 mm) 232, a color filter 234 provided on one side of the transparent substrate 232 that is closer to the liquid crystal layer 260, and transparent electrodes (e.g., an ITO layer) 236 arranged in a stripe pattern on the color filter 234 so as to cross the anodes 214A and the cathodes 214C.

For the liquid crystal layer 260, a TN-mode liquid crystal layer may be used, for example. Of course, the present invention is not limited to this. For example, if a guest-host-mode liquid crystal layer is used, polarizing plates 217 and 237 provided on the outer side of the first substrate 210 and the third substrate 230, respectively, can be omitted. Moreover, depending on the liquid crystal layer to be used, an alignment layer (e.g., an alignment layer made of a polymer film; not shown) is provided on one side of each of the second substrate 220 and the third substrate 230 that is closer to the liquid crystal layer 260. The thickness of the liquid crystal layer 260 is defined by a spacer 262 provided between the second substrate 220 and the third substrate 230.

Figure 5:
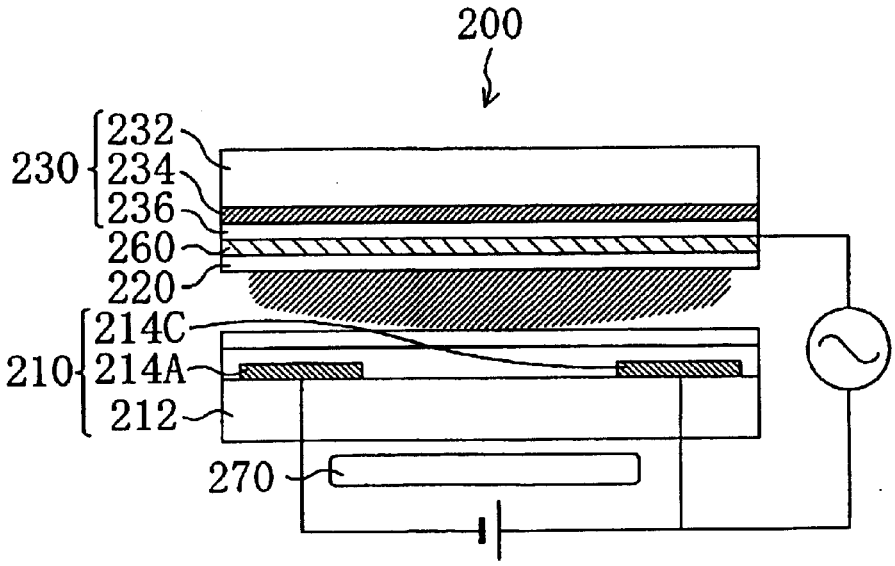
FIG. 5 is a schematic diagram illustrating the operation of the PALC 200 of Embodiment 2 of the present invention.

The operation of the PALC 200 of the present embodiment will be described with reference to FIG. 5. FIG. 5 is a schematic diagram illustrating the operation of the PALC 200 of the present embodiment. Note that FIG. 5 also shows a backlight 270 provided on the outer side of the first substrate 210.

First, a voltage of 100 V to 500 V, for example, is applied between the anode 214A and the cathode 214C so as to cause a plasma discharge in the discharge channel 250. When a plasma discharge occurs, the inside of the discharge channel 250 is turned into a conductive state, and the potential in the discharge channel 250 is brought to be substantially equal to the potential of the anode 214A except for near the cathode 214C.

In synchronism with this, a voltage Ed of 0 V to 100 V, for example, is applied to the transparent electrode 236 of the third substrate 230, whereby a negative charge is induced/stored around one surface of the second substrate 220 that is closer to the discharge channel 250 (hereinafter referred to as "second substrate bottom surface"). Of course, a positive charge may alternatively be stored by applying a voltage Ed of 0 V to −100 V, for example, to the transparent electrode 236. At this time, the liquid crystal layer 260 changes its orientation according to the voltage (potential difference) between the anode 214A and the transparent electrode 236 being distributed to the second substrate 220 and to the liquid crystal layer 260 according to the capacitance ratio therebetween.

Then, when the plasma discharge is stopped, the inside of the discharge channel 250 is brought into an insulative state, and the state where a charge is stored around the second substrate bottom surface is maintained. In other words, the voltage (potential difference) between the second substrate bottom surface and the transparent electrode 236 is sampled/held by the capacitor formed by the second substrate bottom surface, the second substrate 220 and the liquid crystal layer 260, and the transparent electrode 236. As a result, while the inside of the discharge channel 250 is in an insulative state, the orientation of the liquid crystal layer 260 is maintained by the sampled/held voltage.

A method for producing the PALC 200 of the present embodiment will now be described. The PALC 200 of the present embodiment can be produced by using a known PALC production method except for the step of forming the protective layer 218. Therefore, the following description will focus on the step of forming the protective layer 218, and the other steps will not be described.

First, the first substrate 210, in which the anodes 214A and the cathodes 214C have been formed on the transparent substrate 212, is prepared, and then the dielectric layer 216 is formed so as to cover the anodes 214A and the cathodes 214C. These steps can be carried out by using a known method with known materials.

Then, an MgO layer is deposited so as to cover the anodes 214A and the cathodes 214C with the first substrate 210 being heated to a temperature of 200° C. or more, thereby forming the protective layer 218 that contains (220)-oriented MgO and (200)-oriented MgO.

Figure 6:
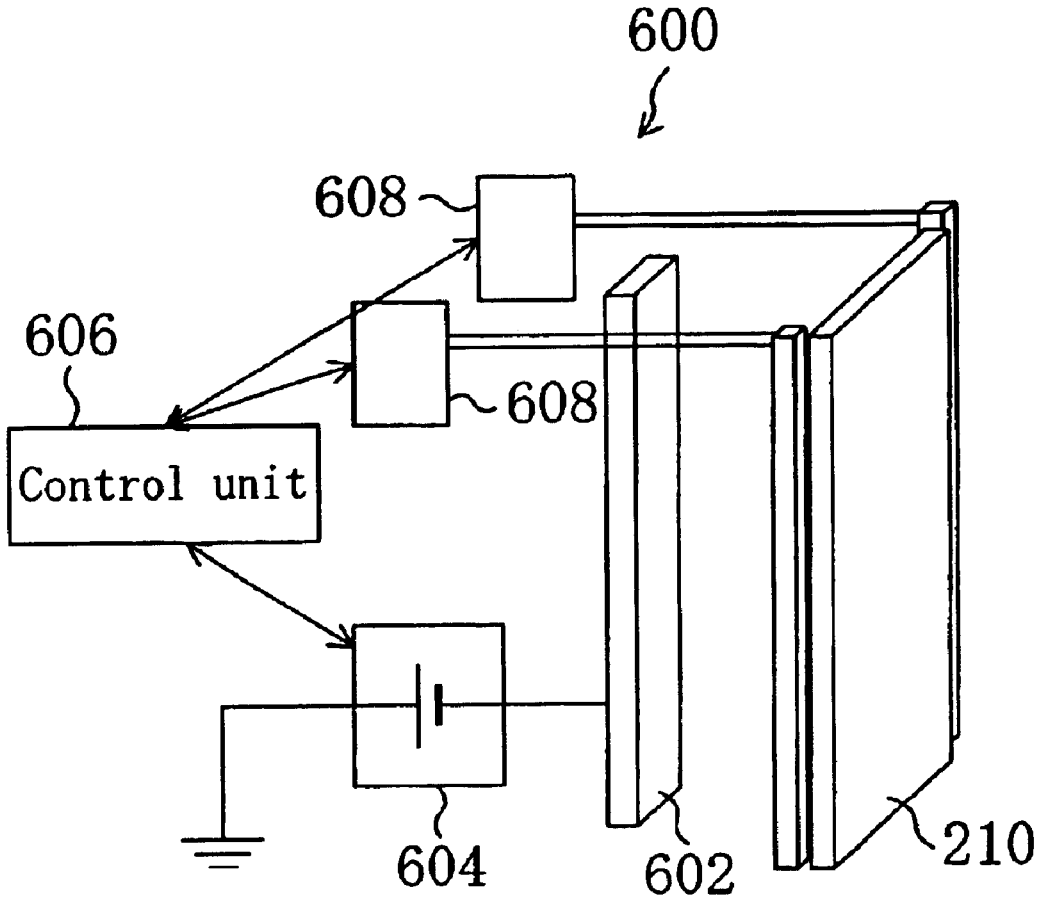
FIG. 6 is a diagram schematically illustrating a reactive sputtering apparatus 600 used in the step of forming a protective layer 218, which is provided in the PALC 200 of Embodiment 2 of the present invention.

The step of forming the protective layer 218 can be carried out as follows using, for example, a reactive sputtering apparatus 600 schematically illustrated in FIG. 6.

First, the first substrate 210, in which the anodes 214A, the cathodes 214C and the dielectric layer 216 have been formed, is positioned to be parallel to an Mg target 602.

Then, the first substrate 210 is heated to a temperature of 200° C. or more by resistance heating or laser irradiation, for example. With the first substrate 210 being heated to a temperature of 200° C. or more, an Ar gas and an $O_2$ gas, which are necessary for a discharge and sputtering, are introduced so that an MgO layer is deposited on the first substrate 210, thereby forming the protective layer 218 that contains (220)-oriented MgO and (200)-oriented MgO. The amount of the $O_2$ gas introduced and the target power to be input from a power source 604 are controlled by a control unit 606. Moreover, in order to improve the sputtering speed, $O_2$ gas introduction ports 608 are located directly above the first substrate 210.

The temperature of the first substrate 210 is preferably equal to or greater than 200° C. and less than or equal to 600° C. in view of the melting points of the materials used in substrates, electrodes and dielectric members, and is more preferably equal to or greater than 200° C. and less than or equal to 400° C. in view of the process time. In the present embodiment, the protective layer 218 having a thickness of about 1 $\mu$m is formed through a deposition process performed for about 15 minutes under conditions where the temperature of the first substrate 210 is 200° C. and the input power is about 7 kW.

Figure 7A:
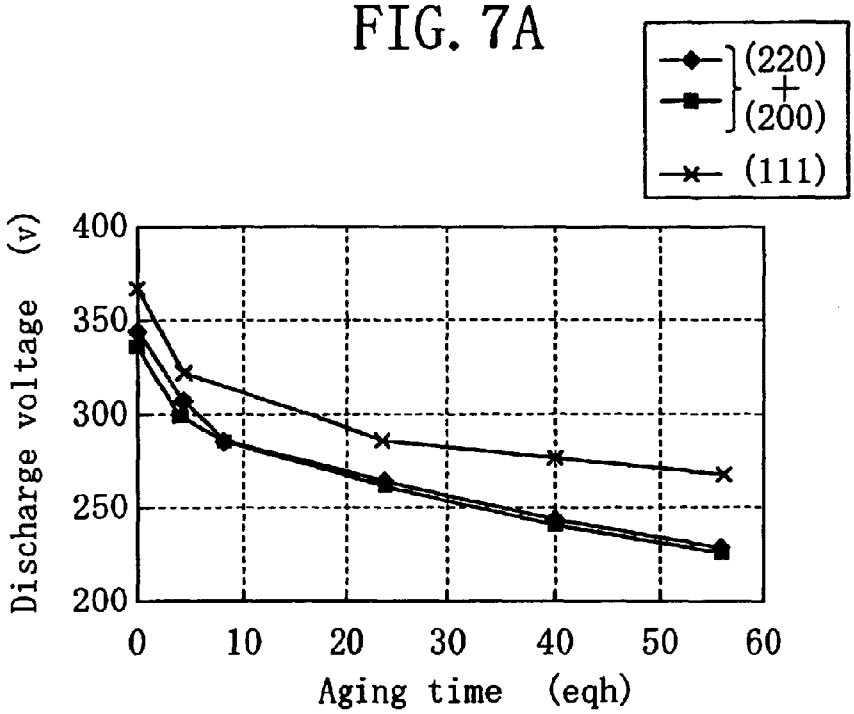
FIG. 7A is a graph illustrating the discharge voltage at initialization of the PALC 200 of Embodiment 2 of the present invention (vertical axis) with respect to the aging time (horizontal axis), where the aging gas is a mixed gas of He and Xe (He 3%).
Figure 7B:
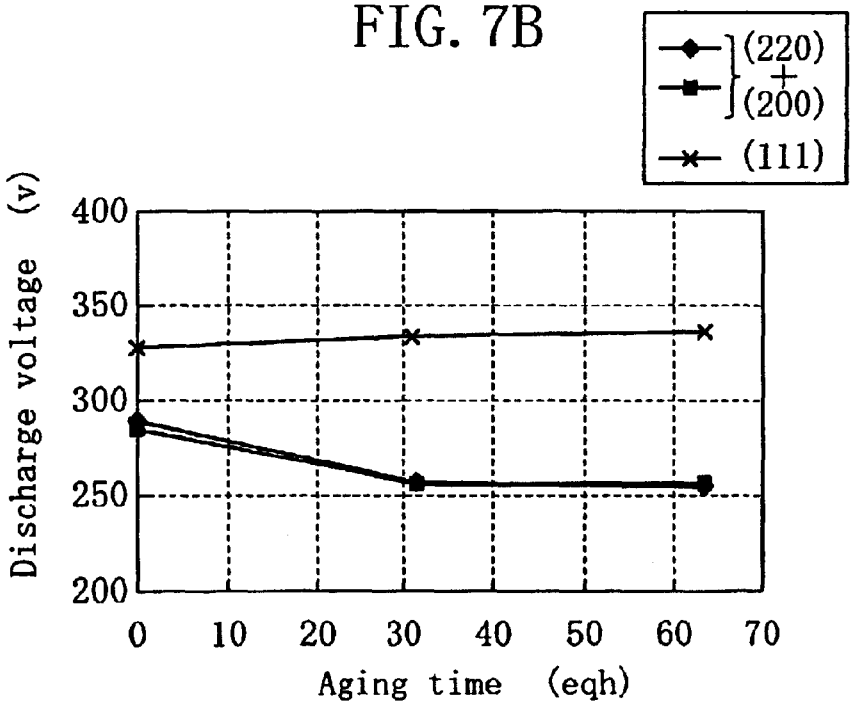
FIG. 7B is a graph illustrating the discharge voltage at initialization of the PALC 200 of Embodiment 2 of the present invention (vertical axis) with respect to the aging time (horizontal axis), where the aging gas is an Xe gas.
Figure 8:
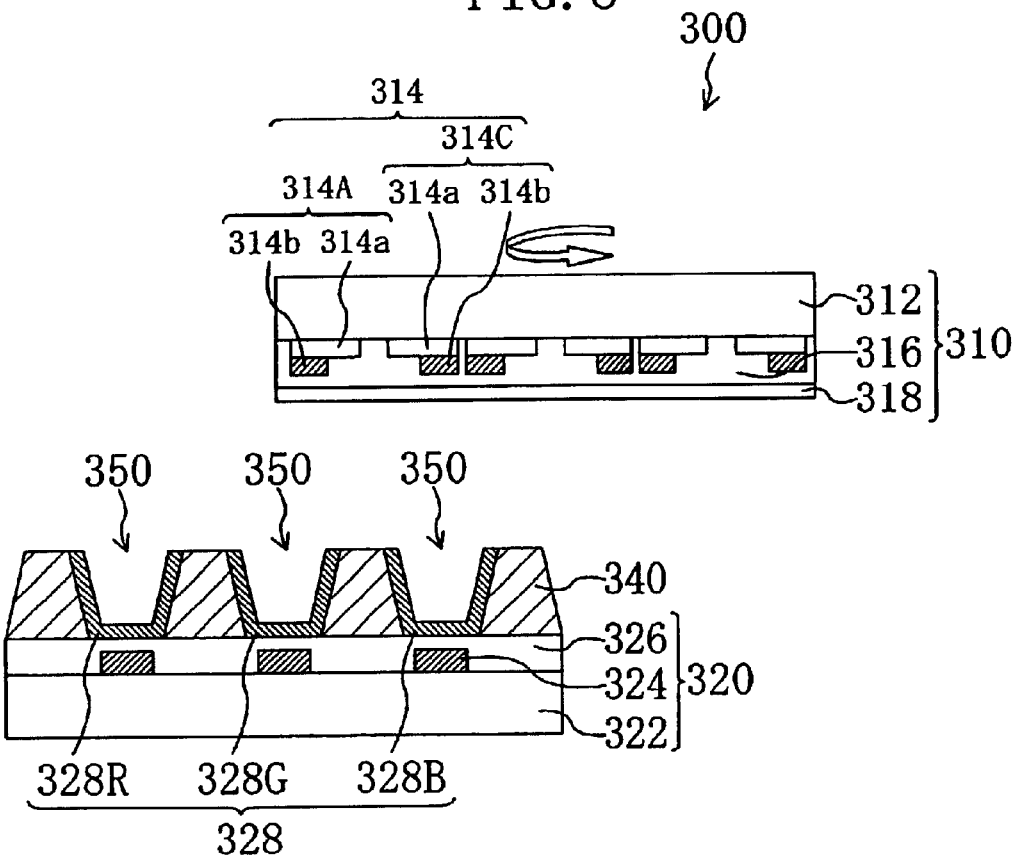
FIG. 8 is a cross-sectional view schematically illustrating a conventional AC-type plasma display panel (PDP) 300.
Figure 9:
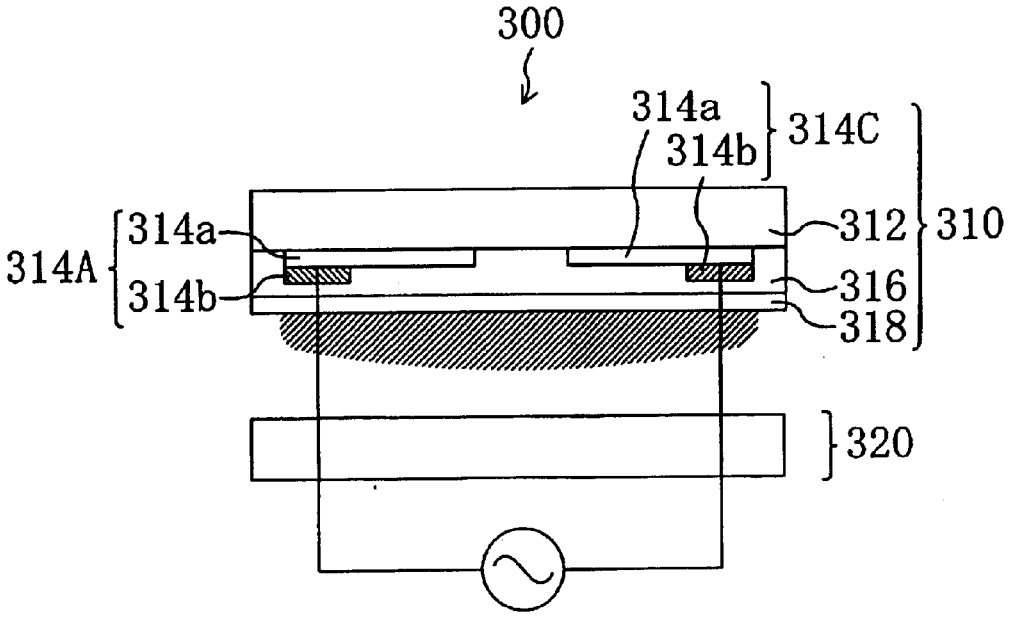
FIG. 9 is a schematic diagram illustrating the operation of the PDP 300.

FIG. 7A is a graph illustrating the discharge voltage at initialization of the PALC 200 that includes the protective layer 218 formed as described above (vertical axis) with respect to the aging time (horizontal axis), where the aging gas is a mixed gas of He and Xe (He 3%). FIG. 7B is a graph illustrating the discharge voltage at initialization of the PALC 200 that includes the protective layer 218 formed as described above (vertical axis) with respect to the aging time (horizontal axis), where the aging gas is an Xe gas. Moreover, FIG. 7A and FIG. 7B also show the discharge voltage at initialization of a conventional PALC that includes a protective layer made of (111)-oriented MgO as a comparative example. Note that the structure of the PALC 200 whose discharge voltage is shown in FIG. 7A and FIG. 7B is different from that shown in FIG. 4 in that the dielectric layer 216 is provided so as to cover only one of the anode 214A and the cathode 214C. Moreover, "initialization" is a step of applying a sufficiently high voltage between the discharge electrodes (the anode and the cathode) of a PALC immediately after it is produced so as to cause a discharge, thereby removing impurities attached to the discharge electrodes through sputtering and cleaning the surface of the discharge electrodes. Since impurities are attached to the surface of the discharge electrodes immediately after the production, it is necessary to apply a relatively high voltage to cause a discharge. The discharge voltage after passage of sufficient aging time is the discharge voltage that is required during the actual use of the PALC.

As illustrated in FIG. 7A and FIG. 7B, the discharge voltage of the PALC 200 including a layer that contains (220)-oriented MgO and (200)-oriented MgO as the protective layer 218 is lower than that of the conventional PALC that includes a protective layer made of (111)-oriented MgO.

Moreover, as described above in Embodiment 1, the protective layer 218 that contains (220)-oriented MgO and (200)-oriented MgO is more compact and has a higher density than a (111)-oriented MgO layer, while having substantially the same anti-sputtering property as that of a (220)-oriented MgO layer.

Thus, in the PALC 200 of Embodiment 2 of the present invention, the protective layer 218, which is provided so as to cover the anodes 214A and the cathodes 214C is a layer that contains (220)-oriented MgO and (200)-oriented MgO. Therefore, it is possible to reduce the discharge voltage while suppressing the sputtering of the protective layer 218 by a plasma discharge.

Note that while Embodiments 1 and 2 have been described above with respect to a case where a dielectric layer is provided between anodes and cathodes and a protective layer, the present invention is not limited to this. For example, the protective layer may alternatively be provided directly on the anodes and the cathodes.

In a case where a protective layer is provided directly on anodes and cathodes, the protective layer typically functions also as the dielectric layer described above. If such a structure where a protective layer is provided directly on anodes and cathodes is employed, the step of forming a layer (e.g., the dielectric layer described above) between the anodes and the cathodes and the protective layer can be omitted, thereby reducing the production cost. Since a dielectric layer is formed through various processes of printing a dielectric material, drying, baking, etc., for example, it is possible to reduce the materials and shorten the production process, thereby reducing the production cost, by employing such a structure as described above.

On the other hand, if a structure where a dielectric layer is provided between anodes and cathodes and a protective layer is employed, the sputtering of the protective layer is better suppressed, thus improving the reliability of the plasma information display element.

Moreover, while Embodiments 1 and 2 have been described above with respect to a case where a protective layer is a layer that is substantially made only of (220)-oriented MgO and (200)-oriented MgO, the present invention is not limited to this. For example, the protective layer may alternatively be a layer that contains (111)-oriented MgO.

Nevertheless, in order to reduce the discharge voltage while realizing a desirable anti-sputtering property, it is preferred that the protective layer is a layer that is substantially made only of (220)-oriented MgO and (200)-oriented MgO.

While the present invention has been described in preferred embodiments, it will be apparent to those skilled in the art that the disclosed invention may be modified in numerous ways and may assume many embodiments other than those specifically set out and described above. Accordingly, it is intended by the appended claims to cover all modifications of the invention that fall within the true spirit and scope of the invention.

What is claimed is:

1. A plasma information display element, comprising:

a first substrate;

a second substrate opposing the first substrate;

a plurality of barrier ribs provided between the first substrate and the second substrate;

a plurality of discharge channels defined by the first substrate, the second substrate and the barrier ribs;

an anode and a cathode provided on one side of the first substrate that is closer to the second substrate; and a protective layer provided so as to cover the anode and the cathode, wherein the protective layer is a layer that contains (220)-oriented MgO and (200)-oriented MgO.

2. The plasma information display element of claim 1, wherein the protective layer is provided directly on the anode and the cathode.

3. The plasma information display element of claim 1, further comprising a dielectric layer provided between the anode and the cathode and the protective layer.

4. The plasma information display element of claim 1, wherein the protective layer is a layer that is substantially made only of (220)-oriented MgO and (200)-oriented MgO.

5. The plasma information display element of claim 1, further comprising:

a third substrate provided so as to oppose the second substrate; and a liquid crystal layer provided between the second substrate and the third substrate.

6. The plasma information display element of claim 1, wherein each of the discharge channels further includes a phosphor layer.

7. A method for producing a plasma information display element, the plasma information display element including: a first substrate; a second substrate opposing the first substrate; a plurality of barrier ribs provided between the first substrate and the second substrate; a plurality of discharge channels defined by the first substrate, the second substrate and the barrier ribs; an anode and a cathode provided on one side of the first substrate that is closer to the second substrate; and a protective layer provided so as to cover the anode and the cathode, the method comprising the steps of:

preparing the first substrate, in which the anode and the cathode have been formed; and forming the protection layer that contains (220)-oriented MgO and (200)-oriented MgO by depositing an MgO-containing layer so as to cover the anode and the cathode with the first substrate being heated to a temperature of 200° C. or more.

* * * * *